United States Patent [19]

Unger

[11] 4,133,156

[45] Jan. 9, 1979

[54] PREFABRICATED WALL FORM AND PRODUCTION METHOD THEREFOR

[76] Inventor: Heinrich B. Unger, P.O. Box 999, Drayton Valley, Alberta, Canada

[21] Appl. No.: 728,778

[22] Filed: Oct. 1, 1976

[30] Foreign Application Priority Data

Oct. 3, 1975 [GB] United Kingdom ..... 40682/75

[51] Int. Cl.[2] ..... E04B 1/24

[52] U.S. Cl. ..... 52/383; 52/405; 52/426

[58] Field of Search ..... 52/561, 562, 426, 563, 52/564, 565, 566, 381, 383, 425, 427, 428, 378, 379, 576, 577

[56] References Cited

U.S. PATENT DOCUMENTS

| | | | |
|---|---|---|---|
| 1,794,678 | 3/1931 | Eastman | 52/426 |
| 1,911,626 | 5/1933 | Larzelere | 52/379 |
| 1,963,978 | 6/1934 | Garrett | 52/378 |
| 2,088,645 | 8/1937 | Fling | 52/565 |
| 2,275,056 | 3/1942 | White | 52/383 |
| 2,647,392 | 8/1953 | Wilson | 52/563 |
| 3,347,007 | 10/1967 | Hale | 52/378 |
| 3,475,873 | 11/1969 | Steadman | 52/562 |
| 3,751,867 | 8/1973 | Layne | 52/426 |
| 3,992,844 | 11/1976 | Gretter | 52/564 |

FOREIGN PATENT DOCUMENTS

| | | | |
|---|---|---|---|
| 107186 | 4/1927 | Austria | 52/405 |

*Primary Examiner*—John E. Murtagh
*Attorney, Agent, or Firm*—Craig & Antonelli

[57] ABSTRACT

The specification discloses a prefabricated wall form adapted to be left in place to provide surfaces after filling said form with a filler, for example, cement. The wall form comprises at least a pair of spaced panels interconnected with a tie-wire mesh structure. The panels consist of at least one layer, preferably, at least two layers of different materials. The tie-wire mesh structure is embedded in the panels and extending laterally within each panel and having linking portions from one panel to the other. The panels may be made of cement mixtures. There is also disclosed a method for producing the prefabricated concrete forms. According to the method, at least a pair of panel forming webs of cement mixture are extruded. After feeding tie-wire mesh structures mounted on mould members between the pairs of webs, the whole structure is pressed to embed the tie-wire mesh structures into the webs. The whole structure thus pressed together is then subjected to heat-curing, for example, steam-curing to set the cement mixture and then cut in a predetermined size. Thereafter, the mould members are removed from the wall forms thus produced. The prefabricated wall forms of the invention are suitable for a long-distance transportation and for a short construction period. They may be assembled without need for highly skilled labor or special equipment.

6 Claims, 14 Drawing Figures

PREFABRICATED WALL FORM AND PRODUCTION METHOD THEREFOR

The present invention relates to a low-cost and fast construction method for buildings, and more particularly, to a prefabricated wall form which can be left in place and a method for producing said forms.

There have been proposed and employed a number of construction methods for buildings. There is a recent trend to employ prefabricated structure components to shorten the construction period and reduce the construction cost. An example of these recent construction methods is the employment of prefabricated concrete panels which may be used for walls or floors. To shorten the construction period of, for example, a house, concrete panels of larger sizes are preferred. However, due to heavy weight thereof, they are not suitable for a long-distance transportation and heavy construction equipment are required to assemble them at a construction site. Furthermore, skilled labour is required to handle such heavy panels. In addition, they have to be surface finished after installation.

To overcome such drawbacks described in the above, there have been reported the employment of a prefabricated concrete wall form which can be left in place. In this method, concrete is poured into the forms after the forms have been assembled at a construction site. Therefore, it is possible to make the concrete wall forms in large sizes which results in shorter construction times. The concrete wall forms are left in place and therefore further wall finishing, which also takes a lot of time, is unnecessary. Thus, this method is a very effective way to cut construction period and cost. Canadian Pat. No. 851,096 issued on Sept. 8, 1970 to Gregori teaches an example of prefabricated wall forms which can be left in place after filling it with concrete and letting the concrete set. Gregori's invention employs two spaced panels joined by interconnecting members. Each panel consists of an outer plastic or gypsum board, which is capable of forming a finished outer wall surface, and an inner board of foamed plastic, which has good thermal insulation properties. However, the interconnecting members are adhesively secured at each ends thereof with the inner boards of both panels and therefore the form is not satisfactory in strength and it is not suitable for automatic continuous production.

A similar idea is also disclosed in Gregori's other Canadian patents, namely, in Canadian Pat. Nos. 838,601 and 826,584 respectively issued Apr. 7, 1970 and Nov. 4, 1969. These two patents employ prefabricated cement form blocks which can be left in place. Due to the rather smaller size of the blocks, they are not effective to reduce construction labour. They also require additional materials to assemble them, for example, in walls.

Accordingly, it is a primary object of the present invention to provide a prefabricated wall form, which may be filled with concrete or another filler, and can be left in place and is suitable for automatic continuous mass-production.

A further object of the present invention is to provide a prefabricated wall form which does not require bracing, tie wires or shoring for assembling.

A still further object of the present invention is to provide a prefabricated wall form which is left in place to provide pre-finished wall surfaces having an excellent water resistive property, which thereby eliminates the necessity of further wall boards, insulating lumber, paper, vapour barrier, bricks, siding and the like.

An another object of the present invention is to provide a prefabricated wall form comprising wood-wool-cement, fiber-cement or foamed cement boards which provide heat and sound insulation and which enable year-around construction without special heating equipment or an anti-freeze additive to the concrete to be poured into the form.

A still another object is to provide a prefabricated wall form which can support joists, ceiling or floor components for assembling a building or house. When further strength is required, the prefabricated wall form can be filled with concrete or other fillers.

A still another object is to provide a prefabricated wall form which is easy to assemble without skillful labour or special equipment.

A still another object of the present invention is to provide a continuous production method for the prefabricated wall forms.

A still another object is to provide tie-wire mesh structures adaptable for the production of the prefabricated wall forms.

This invention provides a prefabricated wall form adapted to be left in place to provide surfaces after filling said form with a filler, said form comprising a pair of spaced panels interconnected with a tie-wire mesh structure, said panels being held in place by said mesh structure and said mesh structure being embedded in the panels and extending laterally within each panel and having linking portions from one panel to the other. This invention further provides a method for continuously producing prefabricated wall forms adapted to be left in place to provide pre-finished wall surfaces after filling said form with a filler, said method comprises continuously preparing at least two separate panel forming webs feeding therebetween tie-wire mesh structures mounted on rectangular or square moulding members, pressing the webs and tie-wire mesh structures together while said whole structure travels through a pressing machine, for instance, a pair of pressing rollers, to embed the tie-wire structures into the panel forming webs, allowing the structure thus formed to set, cutting the structure in a desired size and finally removing the moulding members from the forms thus prepared.

A preferred embodiment for the panel structure is the employment of an outer layer of a wood-cement board or a particle board and an inner layer of wood-wool-cement board, a fiber-cement board or a fiber-binder board such as a fiberPELASPAN board is water and fire resistive, and easy to cut with a conventional cutting tool, for instance, with a saw in a desired size. It is also easy to nail or rivet.

When a prefabricated wall form of the present invention is filled with a fire-resistive material such as cement, the wall structure is imparted an outstanding fire-resistive and fire-barrier properties as there is no empty space in the wall structure and therefore flame or smoke can not propagate through the wall structure.

In one aspect of the present invention, the wall form consists of a pair of panels, each panel having a plural number of layers of same or different materials. In another aspect, the panel consists of an outer layer of a wood-cement board or particle board and an inner layer of a wood-wool-cement board, fiber-cement board, a foamed cement board, or wood-fiber-binder board. An insulation layer, for example, of foamed plastic may be inserted between the two layers of the panel to provide a good heat and sound insulation with the wall form. It still another aspect of the present invention, additional cement or adhesive may be applied between each of two layers of the panel to strengthen the whole structure. A filler suitable for the prefabricated wall form of this invention is concrete, wood-chip-concrete mixtures, plastic-concrete mixtures or fiber-concrete mixtures. In further aspect of this invention, the tie-wire mesh structure comprises a plurality of wires embedded and laterally extending within each panel and having linking portions from one panel to the other, said linking portions being provided with hooks at the ends thereof engaging the laterally extending wires.

In still another aspect of the present invention, there is provided a method for producing prefabricated concrete forms adapted to be left in place to provide prefabricated surfaces after filling said forms with a filler, said method comprises the continuous and consecutive steps of extruding at least a pair of panel forming webs of cement mixture, feeding a tie-wire mesh structure mounted on mould members between said webs thus extruded, pressing the whole structure to embed the tie-wire mesh into the webs, heat-curing the structure, cutting the structure in a size, and removing the mould members from the structure.

In the accompanying drawings, preferred embodiments of the present invention are further illustrated.

Figure 1:
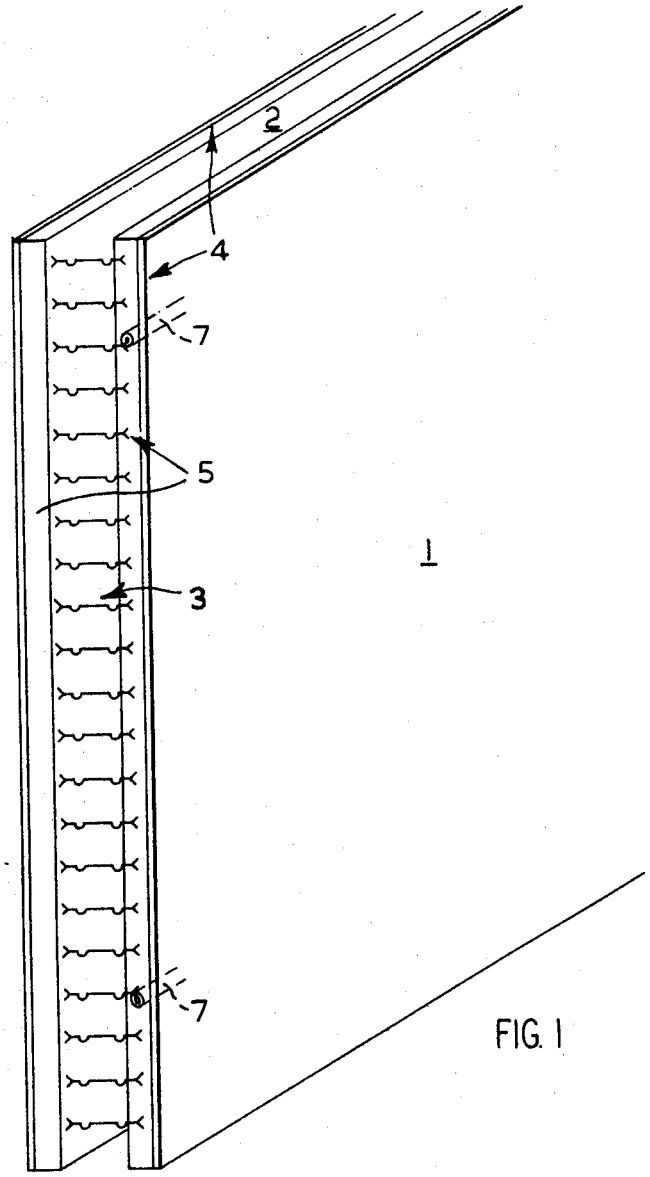
FIG. 1 is a perspective view of a prefabricated wall form before it is filled with a filler.

Referring to FIG. 1 the prefabricated wall form of the invention consists of a pair of parallel spaced panels 1, 2 which are joined together with a tie-wire mesh structure 3. Each panel consists of an outer layer 4 of wood-cement board, particle board or similar materials and an inner layer 5 of a wood-wool-cement board, a fiber-cement board, a wood-wool-binder board or a foamed cement board. Preferably, the outer layer 4 has a good-looking surface so that, after installation, any further surface finishing is unnecessary. The inner layers are provided with holes or pipes 7. The outer surface may be finished with wall paper or textile or by painting, before or after shipping the form to a construction site. The outer layer 4 and inner layer 5 may be bonded together with cement or adhesive if necessary. The both ends of each linking portions of the tie-wire mesh structure are shaped in a hook. If strength is required the end tie-wires are projected at the both ends thereof through the inner layers and are twisted together, rivetted or bonded with a strengthening bar on the outside of the inner layer.

At a construction site, a plural number of prefabricated wall forms are assembled to form walls of a house or building, and a filler may be poured into the hollow space of each form. Concrete is the most preferable filler when strength is required, but any kind of fillers, for instance, wood-chips, saw dust or sand, may be used depending upon the application field of the forms. For temporary structures, sand may be filled into the form, so that the structures are easy to deassemble and can be reused. It is desirable to provide holes or pipes in the inner layer of either one of the panels, preferably the inside panels for electrical wiring, heating, plumbing or similar purposes. A ledge nailer strip may be provided on any side surface of each of the panels. When higher heat or sound insulation is required, an additional insulation layer made of, for example, foamed plastic, can be inserted between the inner and outer layers of each panel. The either one or both of the outer layers of the panels may be omitted when good appearance is not necessary.

Figure 2:
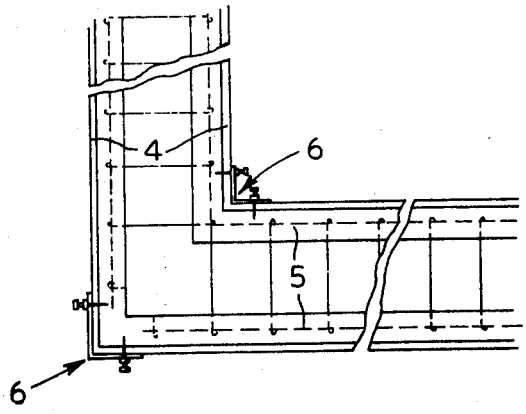
FIG. 2 is a top-plan view showing a corner assembly employing two wall forms of this invention.

In FIG. 2 is illustrated a connection way of two wall forms at a corner of a house or building. The facing sides of both forms are cut with an angle of 45 degrees and secured together by means of metal angles 6 which are nailed onto the outer and inner surfaces of both forms tightly.

Figure 3:
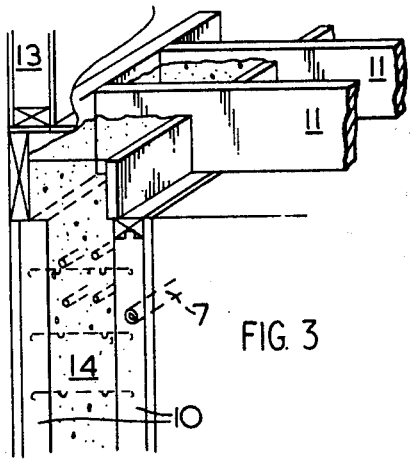
FIG. 3 is an elevational partial cross sectional view of a wall form employed for a basement wall.

FIG. 3 shows a typical basement wall structure employing a prefabricated wall form 10 and joists 11. For above-ground wall structure, a conventional wall 13 is employed. Concrete 14 is filled in the form 10 and enclosing the wires to strengthen the basement wall structure to support the floor and the above-ground wall.

Figure 4:
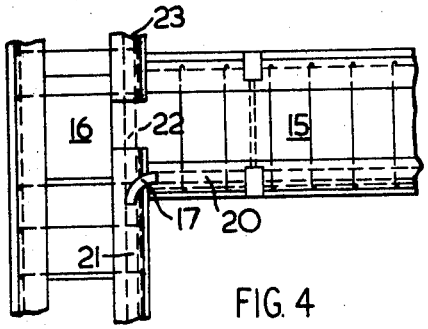
FIG. 4 is a cross-sectional view showing a pipe elbow to be employed to connect two pipes in two wall forms.

In FIG. 4, is shown a prefabricated wall form 15 perpendicularly connected onto one surface of another prefabricated wall form 16. A pipe elbow 17 is employed to connect the pipe 20 of one form with a pipe 21 of the other form. Hole 22 may be made through the panel 23 of the form 16 to deliver filler concrete.

Figure 5:
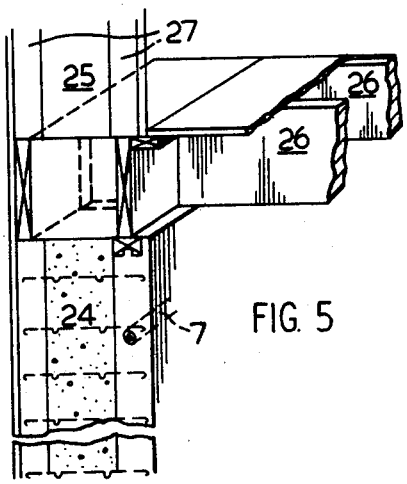
FIG. 5 shows two wall forms and a joist mounted therebetween.

FIG. 5 illustrate two prefabricated wall forms 24, 25 assembled with joists 26 which support the upper floor structure 27.

Figure 6:
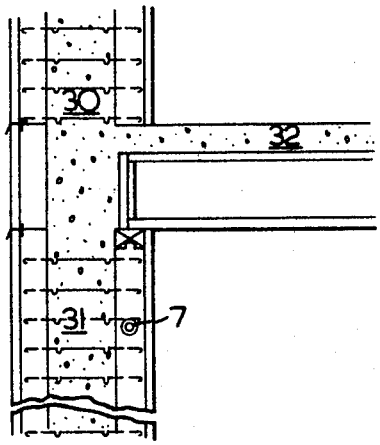
FIG. 6 shows a wall form in combination with a concrete ceiling.

FIG. 6 shows two prefabricated wall forms 30, 31 assembled together with a concrete floor structure 32. The concrete floor may be similar to the prefabricated wall forms.

Figure 7:
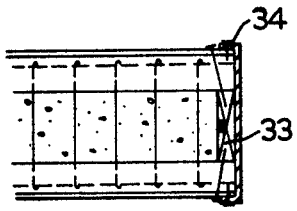
FIG. 7 shows one side of the wall form which serves as one side of a frame for window or door installation.

One end of the form is illustrated in FIG. 7, where a concrete stop block 33 is inserted into the extreme end of the space and the side of the form is covered by an end strip 34. This structure is suitable for forming a window or door opening.

Figure 9:
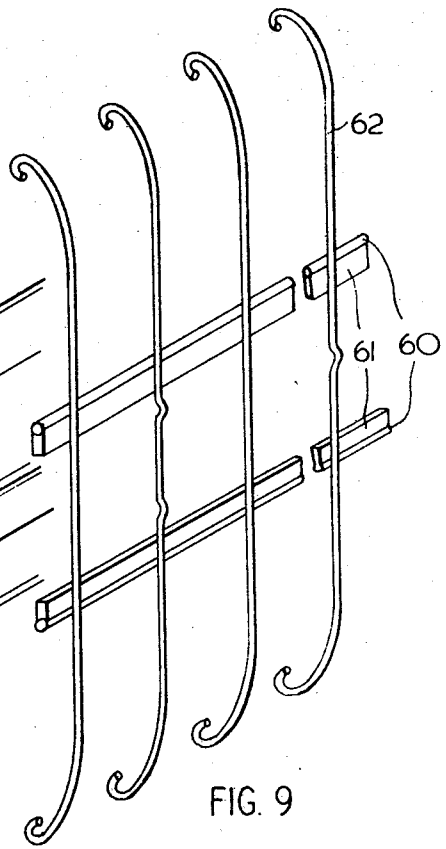
FIG. 9 shows a wire unit member prior to mounting on a mould member, adapted in the embodiment of FIG. 8.
Figure 8:
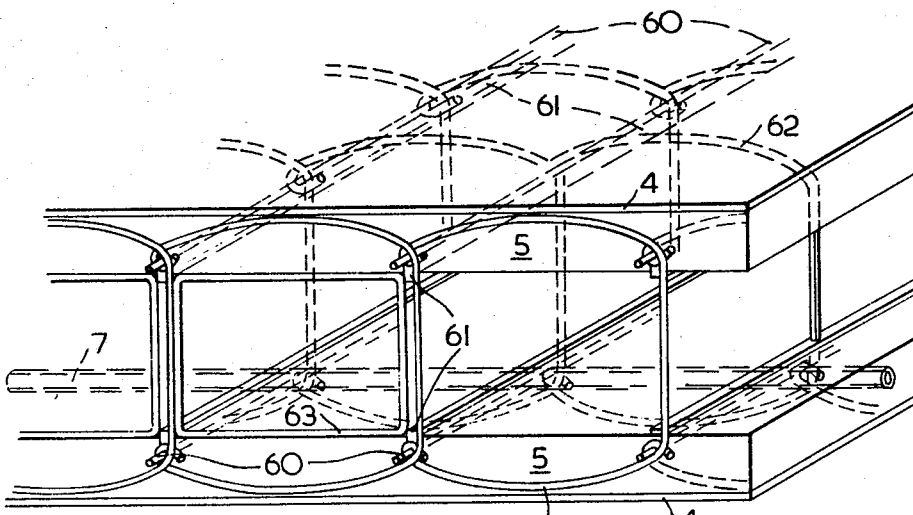
FIG. 8 is a perspective view of another embodiment of wall forms according to the present invention.

In FIG. 8 and FIG. 9, there is illustrated another embodiment of the tie-wire mesh structure of the present invention. The tie-wire mesh structure comprises a plurality of wire unit members as shown in FIG. 9. The wire unit member comprises a pair of spaced first wires 60 equipped with sealer strips 61. A plurality of spaced second wires 62 are perpendicularly extending to the first wires. The second wires are equipped with hooks at the ends thereof. The first wires and the second wires are secured together by welding. As seen in FIG. 8, the wire unit member is mounted on a mould member 63. The second wires 62 are bent over the upper and the bottom surface of the mould member and engaged with the first wires of the adjacent wire unit member. The sealer strips 61 serve to prevent the cement mixture 5 from flowing into the spacing between each two mould members during the production thereof. The portions of the second wires 62, which portion being over the upper and bottom surfaces of each mould member and being within the inner layers 5, are preferably placed as deep as possible within the inner layers for higher strength.

Figure 11:
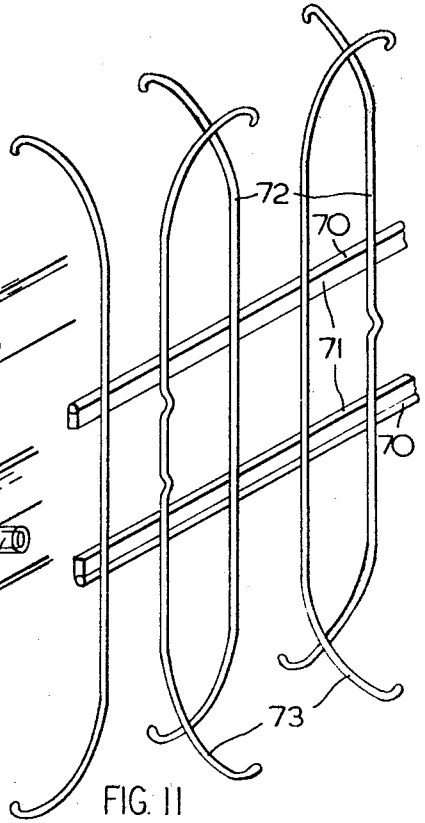
FIG. 11 shows a wire unit member, prior to mounting on a mould member, adapted in the embodiment of FIG. 10.
Figure 10:
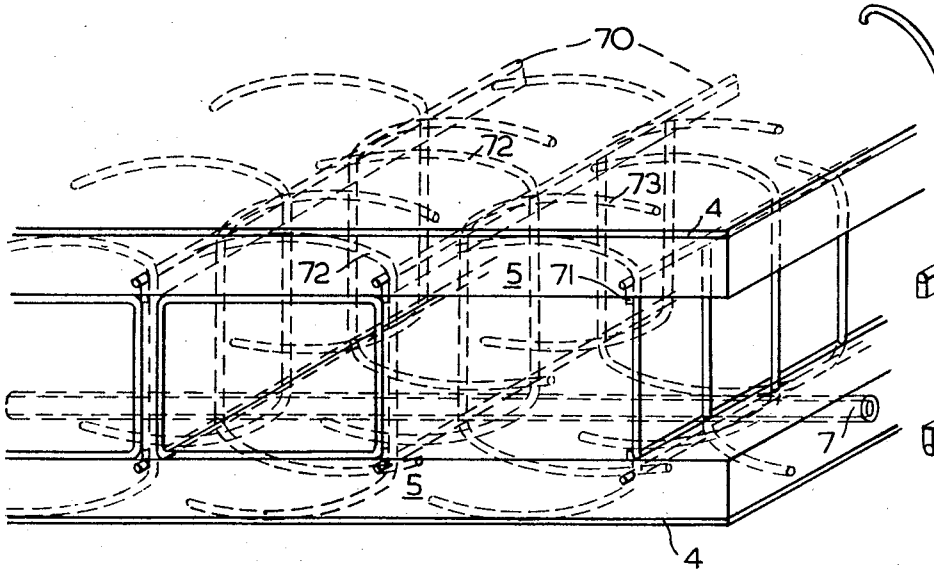
FIG. 10 is a perspective view showing another embodiment of wall forms according to the present invention.

FIGS. 10 and 11 illustrate another embodiment the tie-wire mesh structure of the present invention. The tie-wire mesh structure comprises a plurality of wire unit members as shown in FIG. 11. The wire unit member comprises a pair of spaced first wires 70 having sealer strips 71 thereon. A plurality of spaced second wires 72, 73 are perpendicularly secured to the first wires by welding. As seen in FIG. 10, the second wires 72 are bent leftward over a mould member and the second wires 73 are bent rightward over another mould member. The end portions of the second wires extend at least to the first wires of adjacent mould members. The sealer strips 71 serve to prevent the cement mixtures flowing into the spacing between each two mould members during the production thereof.

Figure 13:
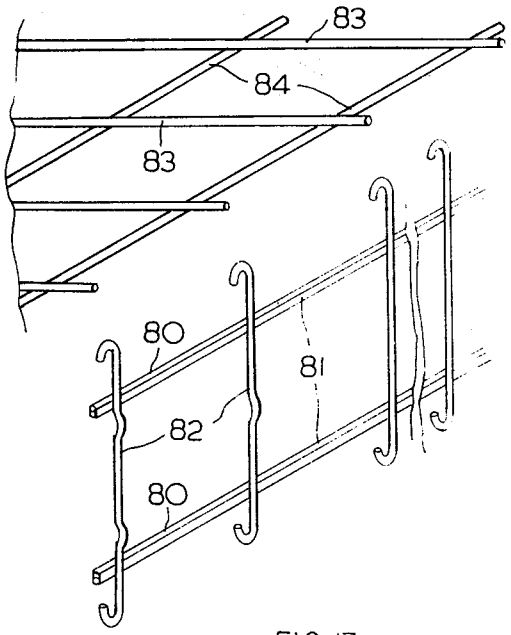
FIG. 13 shows a wire unit member adapted to form the tie-wire mesh structure in FIG. 12.
Figure 12:
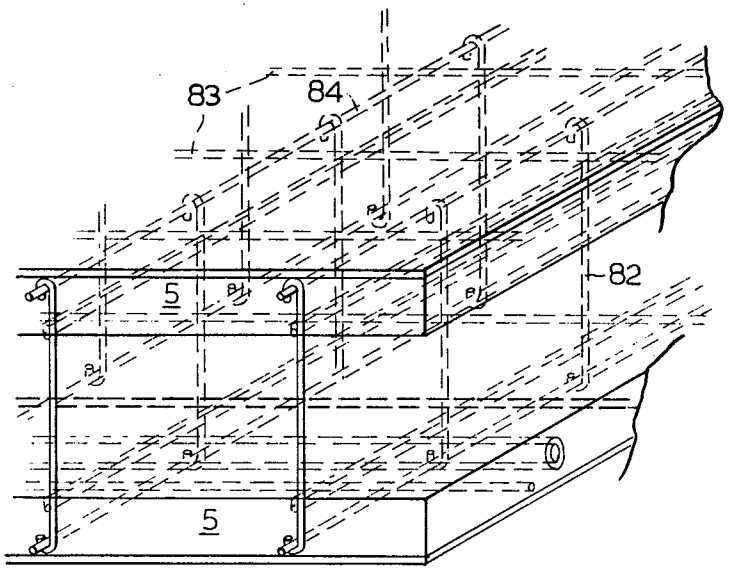
FIG. 12 is a perspective view showing another embodiment of the wall forms according to the present invention.

Another embodiment of the tie-wire mesh structure of this invention is illustrated in FIG. 12. Each wire unit member forming the tie-wire mesh structure is further illustrated in FIG. 13 The tie-wire mesh structure is formed with a pair of spaced mesh consisting of a plurality of longitudinal wires 83 and a plurality of transverse wires 84 thereby forming intersections with which the hooks provided at the ends of the linking wires 82 are engaged. The linking wires 82 are integral with another set of linking wires 80 extending perpendicularly to the linking wires 82. The linking wires 80 are equipped with sealer strips 81.

A preferred material for use in forming the inner panel portion, in which the tie wires are embedded, to form the empty parallel spaced panels 1,2, (portions 5 thereof), is the material known by the trade mark "STYROPOR-BETON", sold by BASF-Ag., Ludwigshafen/Rhein, West Germany. This consists of expanded polystyrene granules mixed with cement, and if desired, a small amount of fine sand. A typical formulation consists of 1,085 $dm^3/m^3$ of STYROPOR, 380 $kg/m^3$ of cement, 90 $kg/m^3$ of sand (o/lmm) and water 140 $kg/m^3$. This material has great strength and rigidity to hold the tie wires in place, but is workable to the extent that it can be sawed, nailed, etc.

One end of the form is illustrated in FIG. 7, where a concrete stop block 33 is inserted into the extreme end of the space and the side of the form is covered by an end strip 34. This structure is suitable for forming a window or door opening.

Figure 14:
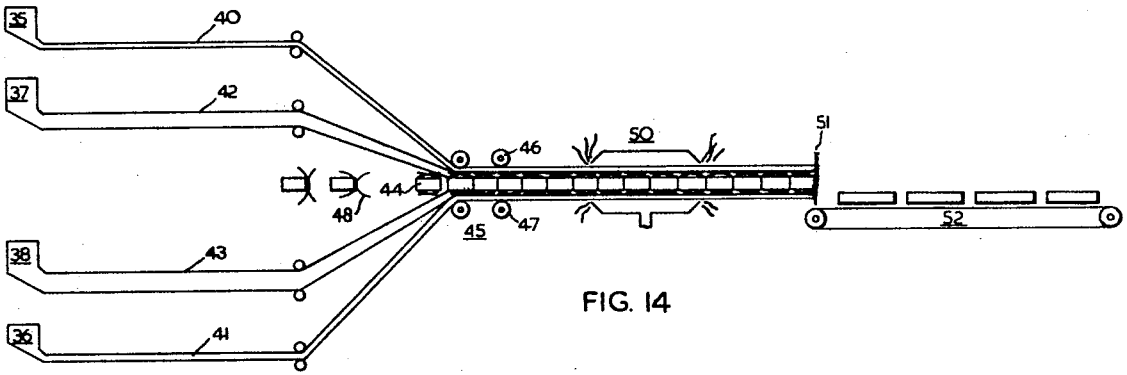
FIG. 14 shows a diagram of a continuous production method of wall forms of this invention.

An embodiment of the continuous production method of the wall forms of the present invention is illustrated in FIG. 14. This embodiment is adaptable to produce the wall forms as illustrated in FIG. 10. Raw material mixture, for example, wood-cement mixture, is fed into the extruders 35, 36. Different raw material mixture, for example, wood-wool-cement mixture, is fed into the extruders 37, 38. The mixtures are then continuously and separately extruded into panel forming webs 40, 41, 42, 43. Wire unit tie-wire members 48, each mounted on a rectangular moulding member 44, are continuously fed between the two inner webs. The whole structure then travels toward a pressing zone 45 where plural sets of a pair of upper and lower pressing rollers 46, 47 are provided. While travelling through the pressing zone, the tie-wire mesh are embedded into the two inner webs. The whole structure then travels into a steam curing zone 50 to allow the cement mixtures to set. Thereafter, the web structure is automatically cut by means of a jig saw 5 into a predetermined size which is equivalent to the longitudinal distance of each mould member. The mould members are removed, for example, by pushing out from the wall forms (not shown). Prefabricated wall forms are then conveyed to a storage room by the conveyor 52. The mould members thus removed from the wall forms are mounted with tie-wire mesh for reuse.

Inasmuch as the present invention is subject to many variations, modifications and changes in detail, it is intended that all matter described above or shown in the accompanying drawings be interpreted as illustrative and not in a limiting sense.

What is claimed is:

1. A prefabricated wall form adapted to be left in place to provide surfaces after filling said form with a filler, comprising a pair of spaced panels interconnected with a tie-wire mesh structure including a plurality of wire unit members, each wire unit member having a pair of first wires transversely and laterally extending in the panels and a plurality of second wires perpendicular to the first wires and secured thereto, said panels each consisting of a plural number of layers of different materials and being held in place by said mesh structure, said second wires being alternately bent toward both adjacent wire unit members, the bent portions of the second wires being within the panels and the ends of the bent portions extending at least as far as the first wires of the adjacent wire unit members.

2. The prefabricated wall form as claimed in claim 1, wherein each of said panels consists of an outer layer of a wood-cement board or a particle board and an inner layer of a wood-wool-cement board, a fiber-cement board, a foamed cement board, or a wood-fiber-binder board.

3. The prefabricated wall form as claimed in claim 2, wherein an insulation layer is inserted between the inner and the outer layers.

4. The prefabricated wall form as claimed in claim 1, wherein cement or adhesive is applied between each two layers.

5. The prefabricated wall form as in claim 1, wherein said filler is of a material selected from the group consisting of concrete, foamed concrete, wood chip-concrete mixtures, plastic-concrete mixtures and fiber-concrete mixtures.

6. The prefabricated wall form as in claim 1 wherein the first wires are equipped with sealer strips, a portion of said sealer strips being laterally and transversely projecting into the spacing between both panels.

* * * * *